US006112793A

United States Patent [19]

Gehrmann

[11] Patent Number: 6,112,793

[45] Date of Patent: Sep. 5, 2000

[54] DEVICE FOR PRODUCTION OF CORRUGATED CARDBOARD

[75] Inventor: Rudolf Gehrmann, Hamburg, Germany

[73] Assignee: Peters Maschinenfabrik GmbH, Hamburg, Germany

[21] Appl. No.: 09/151,470

[22] Filed: Sep. 11, 1998

[30] Foreign Application Priority Data

Sep. 15, 1997 [DE] Germany ..... 197 40 512

[51] Int. Cl.[7] ..... B31F 1/28

[52] U.S. Cl. ..... 156/472; 156/470

[58] Field of Search ..... 156/469, 470, 156/471, 472, 473, 209, 210; 264/286, 287; 425/336, 369; 428/182; 493/463

[56] References Cited

U.S. PATENT DOCUMENTS

| | | | |
|---|---|---|---|
| 1,971,667 | 8/1934 | Weeks | 264/286 |
| 2,717,423 | 9/1955 | Uhlig et al. | 264/286 |
| 2,838,416 | 6/1958 | Babiarz et al. | 264/286 |
| 3,053,309 | 9/1962 | Wilson . | |
| 4,101,367 | 7/1978 | Maier . | |
| 4,531,996 | 7/1985 | Sukenik . | |

FOREIGN PATENT DOCUMENTS

| | | |
|---|---|---|
| 0 098 936 A1 | 1/1984 | European Pat. Off. . |
| 0098936 | 9/1986 | European Pat. Off. . |
| 0 681 909 A2 | 11/1995 | European Pat. Off. . |
| 26 11 325 U | 9/1976 | Germany . |
| 2 284 433 | 6/1995 | United Kingdom . |

OTHER PUBLICATIONS

Excerpt from English language version of document referred to on p. 6, line 15 of specification.

*Primary Examiner*—Michael W. Ball
*Assistant Examiner*—Barbara Musser
*Attorney, Agent, or Firm*—Allen N. Friedman; McCarter & English, LLP

[57] ABSTRACT

A device for production of corrugated cardboard, comprising a first fluted roller (1) and a second fluted roller (2) together forming a corrugating gap (3), a pressure contact roller (4) forming a pressure contact gap (5) together with the second fluted roller (2), feeding means (18) to feed a corrugating strip (16) to the corrugating gap (3) in which the corrugating strip (16) is deformed to make the corrugated strip (20), feeding means (26, 28) to feed a smooth strip (24) to the pressure contact gap (5) in which the smooth strip (24) is pressed into contact with the corrugated strip (20) with an intermediate glue layer to produce a composite strip, and advancing means (36, 38, 40) to advance the composite strip (34) formed by bonding the corrugated strip (20) to the smooth strip (24). Each of the two fluted rollers (1, 2) has a fluted profile on its periphery with profile peaks (PS1, PS2) and profile valleys (PT1, PT2) cooperating in the corrugating process. Successive profile peaks (PS1, PS2) and profile valleys (PT1, PT2) of each fluted roller (1, 2) are joined to each other by profile flanks (PF1, PF2). Further, the profile peaks (PS1, PS2) of each fluted roller (1, 2) have a sharper curvature than the profile valleys (PT2, PT1) of the meshing fluted roller that cooperates to produce corrugation. At the same time, the profile peaks (PS1) of the first fluted roller (1) are provided with a sharper curvature than the profile peaks (PS2) of the second fluted roller (2) and that the profile valleys (PT1) of the first fluted roller (1) are provided with a flatter curvature than the profile valleys (PT2) of the second fluted roller (2).

6 Claims, 3 Drawing Sheets

DEVICE FOR PRODUCTION OF CORRUGATED CARDBOARD

RELATED APPLICATIONS

This Application depends for priority on German Application No. 197 40 512.6, filed Sep. 15, 1997.

FEDERALLY SPONSORED RESEARCH

Not Applicable

BACKGROUND OF THE INVENTION

1. Field of the Invention

The invention is related to the production of corrugated cardboard.

2. Brief Description of the Background Art

The invention relates to a device for production of corrugated cardboard comprising:

a) a first fluted roller and a second fluted roller, which together make a corrugated deforming gap;

b) a pressure contact roller, which together with the second fluted roller makes a pressure contact group;

c) a feeding means to feed a strip to be corrugated to the corrugated deforming gap, in which the strip to be corrugated is formed into a corrugated strip; and d) a feeding means to feed a smooth strip to the pressure contact gap, in which the smooth strip is pressed into contact with the corrugated strip, with an intermediate glue layer, and advancing means to advance the composite strip produced by bonding the corrugated strip and the smooth strip, wherein each of the two fluted rollers has a fluted profile on its periphery with peaks and valleys extending in the respective axial direction and cooperating in the corrugated deformation, successive profile peaks and valleys of each fluted roller being defined by profile flanks, and the profile peaks of each fluted roller having a sharper curvature than the profile valley of the respective other fluted roller corrugatingly cooperating with them.

Devices of this kind are built with fluted rollers of different shapes, the profile being determined by the pitch (i.e., the distance between successive teeth) and tooth height. In the process of production, the paper strip is compressed under pressure and heat between the profiles of the meshing fluted rollers and then bonded to a smooth covering strip. This too, as a rule, is done under the action of heat and pressure by means of a so-called pressure contact roller or press roller.

The actual corrugation forming process takes place between the respective fluting or profile peaks of the one fluted roller and the bottom of the flutings, or the profile valleys, of the other fluted roller. The flank as a rule does not participate. In these designs, the difference between the radii of cooperating profile peaks and valleys is critical.

In conventional corrugating devices, the profiles of the two fluted rollers are identical, so that the corrugation of the paper is the same in both directions of flexure, and a symmetric profile of the finished corrugated paperboard results.

In the region of contact between the second fluted roller and the pressure contact roller, contact between the profile peaks of the second fluted roller and the essentially cylindrical surface of the pressure contact roller takes place. As a result of this, the axial distance between these two rollers, defined by the contact between the second fluted roller and the pressure contact roller, varies continually in the course of rotation of the rollers between a maximum value, when a profile peak is located in the region of a plane containing the centerlines of the rollers, and a minimum distance, when a profile valley of the second fluted roller is located in the connecting plane containing the centerlines of the rollers. This distance variation leads to a continual excitation of vibrations, the amplitude of vibration that occur resulting in surface marking of the pressure contact roller side of the smooth strip and, especially in intervals of resonance, possible damage to the paper fibers in the pressure contact gap. The wider the pitch of the fluted profile, the greater the damaging amplitude of vibration may become. To solve this problem, one might consider working with lower pressures and longer exposure time between the second fluted roller and the pressure contact roller. Providing a longer exposure time would be needed to establish intimate connection between the corrugated strip and the smooth strip.

SUMMARY OF THE INVENTION

A consideration in connection with the instant invention is that an essential factor influencing damage to the paper on the pressure contact roller side of the smooth strip is the curvature and especially the vertex curvature of the profile peaks of the second fluted roller. The greater the radius of curvature of the profile peaks, the less the vibrational pressure acting on the paper. However, the curvature cannot be diminished at will, or to put it differently, the radius of curvature in the vertex region of the profile peaks cannot be increased at will. For with increasing radius of curvature, for given pitch, the flank angle with respect to a pitch circle of the profile increases. This soon leads to interference with the rolling of the profiles of the first and second fluted rollers on each other, the paper is overstressed, and finally the teeth will catch each other. Increasing the pitch can indeed, compensate the enlargement of the flank angle, but this does not help if, in view of the transmission of pressure by the composite strip made up of the smooth strip and the strip to be corrugated, a particular pitch is desired.

Furthermore, an increase of the pitch leads in turn to an increased risk of excitation of vibrations, since this pitch too is responsible for the fluctuation of the axial distance between second fluted roller and pressure contact roller, for simple geometrical reasons. Increased pitch leads to increased fluctuations of the radial distance between centerlines of second fluted roller and pressure contact roller.

Incidentally, the idea of reducing paper damage on the pressure contact roller side of the smooth strip by enlarging the peak radius also leads to the adverse effect of increasing the consumption of paper, since in that situation the path of the paper between a profile peak vertex and a profile valley vertex of the fluted rollers will depart increasingly from the straight line connecting these two verticals, which is the shortest line connecting these vertex points.

The object of the invention is to so construct a device of this generic kind that the excitation of vibration is reduced and the danger of producing markings on the corresponding composite strip as well as of fiber damage is reduced. In addition, the danger of mutual engagement, i.e. the risk of interference between the cooperating teeth of the two fluted rollers, is to be avoided.

To accomplish this object, it is proposed, according to the invention, that the profile peaks of the first fluted roller have a sharper curvature than the profile peaks of the second fluted roller, and that the profile valleys of the first fluted roller have a flatter curvature than the profile valleys of the second fluted roller.

The composite strip created in the device according to the invention may be a one-sided corrugated cardboard, to be used as such, for example for wrapping cylindrical objects. Alternatively, the composite strip may be an intermediate product for a two-sided or multi-layer corrugated cardboard. The term "Wellpappe" (corrugated cardboard) is intended, in particular, to subsume composite strips produced using fibrous, and more particularly cellulosic unit strips. However, the composite strip may consist of other materials, for example plastic strips, capable in principle of being processed to produce one-sided corrugated composite strips.

The instant invention is based on the idea that it is only where the profile ribs of the second fluted roller, with interposition of the corrugated strip and the smooth strip, are in contact with each other under pressure of the pressure contact roller, that enhanced excitation of vibrations and increased pressures occur.

At the profile peaks of the first fluted roller, more sharply curved in the conformation according to the invention, correspondingly more sharply curved convex corrugations of the strip to be corrugated are formed. But these more sharply curved corrugations in the strip to be corrugated are not disadvantageous to the resulting product. Even if the corresponding composite strip is further processed to a two-sided corrugated paperboard ("double face), the corrugations will be bonded to a smooth paper strip in an essentially plane joining segment, where no vibrations can occur, and hence the influence of the peak radius is slight.

The proposal according to the invention may be applied, no matter whether the profile peaks of the fluted rollers are curved in circular arcs or have some other form of curvature, say by combination of several circular arcs. With circular arc curvature of the profile peaks of the fluted rollers, the idea of the invention is that the profile peaks of the fluted rollers are curved in circular arcs and the profile peaks of the second fluted roller have a larger radius of curvature than the profile peaks of the first fluted roller.

The profile valleys of the fluted rollers may be circularly curved as well, particularly if the profile peaks also are circularly curved. Then the profile valleys of the first fluted roller have a larger radius of curvature (i.e., a flatter curvature) than the profile valleys of the second fluted roller. Preferably, the two fluted rollers are built to the same pitch; i.e., they have equal distances; between successive profile peak vertices.

A preferred dimensioning exists if the difference between the radius of curvature of the profile valleys of the second fluted roller and the radius of curvature of the profile peaks of the first fluted roller is approximately, or preferably exactly, equal to the difference between the radius of curvature of the profile valleys of the first fluted roller and the radius of curvature of the profile peaks of the second fluted roller.

The flank curve between successive profile peaks and profile valleys may be varied within wide limits, provided only it is assured that no interference results. The idea of the invention may for example be combined also with the principle of so-called 'bone profiles,' where concave flank conformation thickens the profile peaks in their extent along the pitch circle. Such a 'bone profile' is represented for example in a paper "Die einseitige Gruppe," publication No. 1 (793 D) 0.5 by firm of Peters Maschinenfabrik GmbM., Rondenberg 9-17, 22525 Hamburg, and described therein. Reference is also made, on so-called 'bone profiles,' to the patent EP 0,098,936.

BRIEF DESCRIPTION OF THE DRAWINGS

The accompanying figures illustrate the invention with reference to an exemplary embodiment.

DETAILED DESCRIPTION OF THE INVENTION

Figure 1:
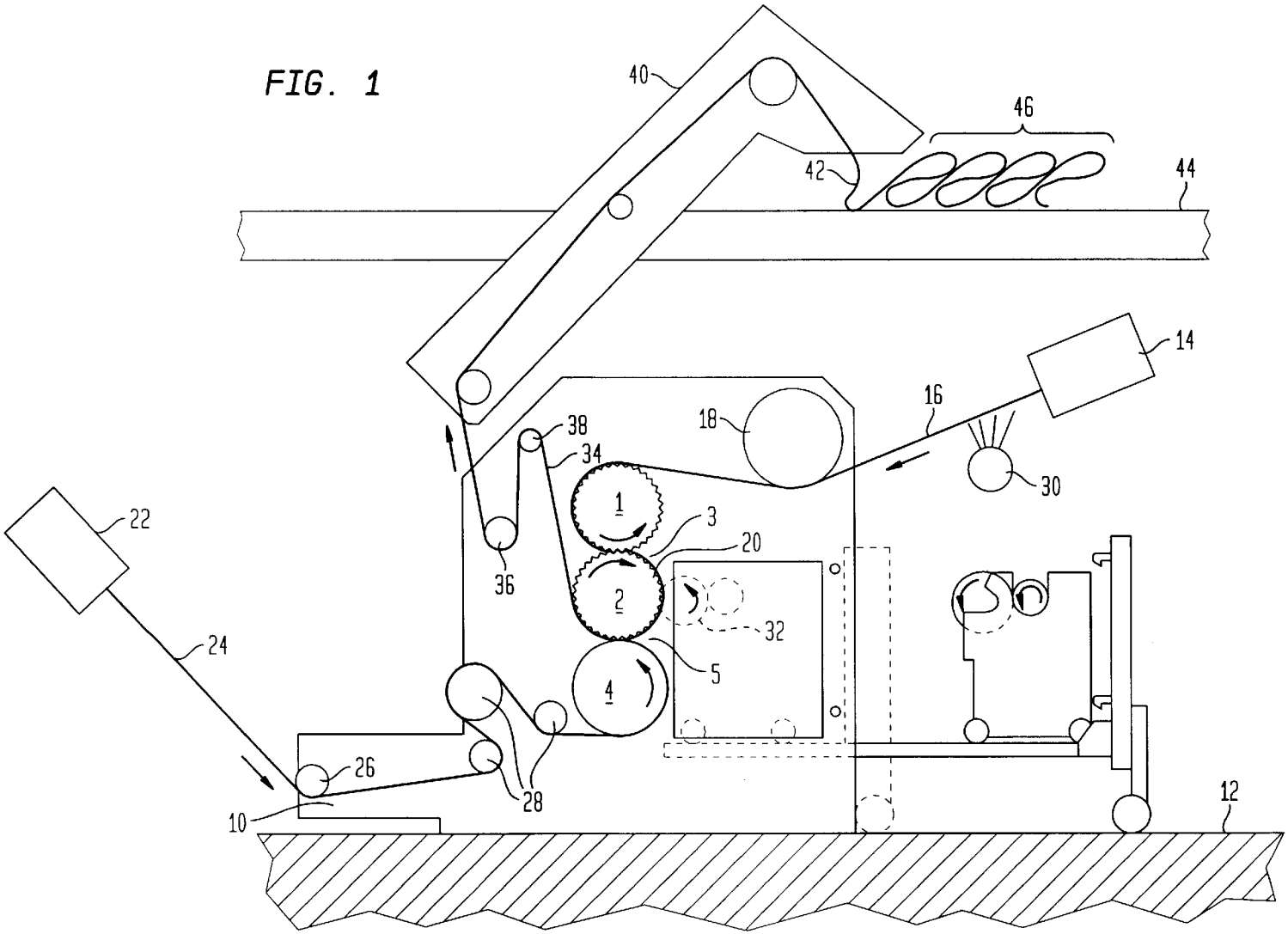
FIG. 1 shows a schematic elevational view of a device according to the invention for producing one-sided corrugated cardboard.

In FIG. 1, a machine frame is marked 10. It stands on a machine foundation 12. Mounted on the machine frame are a first fluted roller 1, a second fluted roller 2 and a pressure contact roller 4. A pressure contact device presses the first fluted roller 1 against the second fluted roller 2, and also the pressure contact roller 4 against the second fluted roller 2. The first and second fluted rollers 1, 2 together form a corrugating gap 3. The pressure contact roller 4 and the second fluted roller 2 together form a pressure contact gap 5.

From a supply indicated at 14 in the schematic diagram, a corrugating strip 16 passes under an idler roller 18 to the first fluted roller 1 and along the first fluted roller 1 to the corrugating gap 3. After passing through the corrugating gap 3, the initially smooth corrugating strip 16 is deformed to a corrugated strip 20. This corrugated strip 20, resting on the second fluted roller 2, proceeds to the pressure contact gap 5, yet to be described in detail. From a supply 22, a smooth strip 24 passes under an idler 26 and tension means 28 to the pressure contact roller 4 and, resting on it, into the pressure contact gap 5. In the pressure contact gap 5, the corrugated strip 20 is bonded to the smooth strip 24.

Deformation of the smooth strip 16 to form the corrugated strip 20 is facilitated by moistening and heating the smooth paper strip 16 before entering the corrugating gap 3. The smooth strip 16 is moistened by a moistening means 30, schematically indicated, and heated, for example, by steam-heating the idler 18. The smooth strip 16, thus moistened and heated, then passes through the corrugating gap 3, formed by the fluted rollers 1, 2, heated to about 180° C. After passing through the corrugating gap 3, the corrugated strip 20 now created out of the smooth paper strip 16 is so stabilized in its corrugated form that it travels to the pressure contact gap 5 while resting on the fluted roller 2. Contact between the corrugated strip 20 and the fluted roller 2 may be assisted by either pressing the corrugated strip 20 into contact with the outer periphery of the fluted roller 20 inside of a pressurized chamber not shown, or by use of suction maintained inside of the fluted roller 2 and applied at the profile valleys of the fluted roller 2, for example through peripheral grooves. This suction presses the corrugated strip 20 against the peripheral profile of the fluted cylinder 2 with simultaneous action of atmospheric pressure on the radially outer side of the corrugated strip 20.

Schematically, FIG. 1 also shows a gluing mechanism 32 by which glue is applied to the radially outer side of the corrugated strip 20. Glue is applied to the crests of the convex corrugations pointing radially outward, whereupon the corrugated strip 20 with glue and the smooth strip 24 together pass into the pressure contact gap 5, there to be pressed into contact with each other, constituting a first gluing stage. The composite strip 34 consisting of the corrugated strip 20 and the smooth strip 24 then passes over idlers 35, 38, while maintaining an approximately constant tension, into a conveyor 40, which deposits the one-sided composite strip in loops, as indicated at 46, on a lengthwise conveyor 44.

Figure 2:
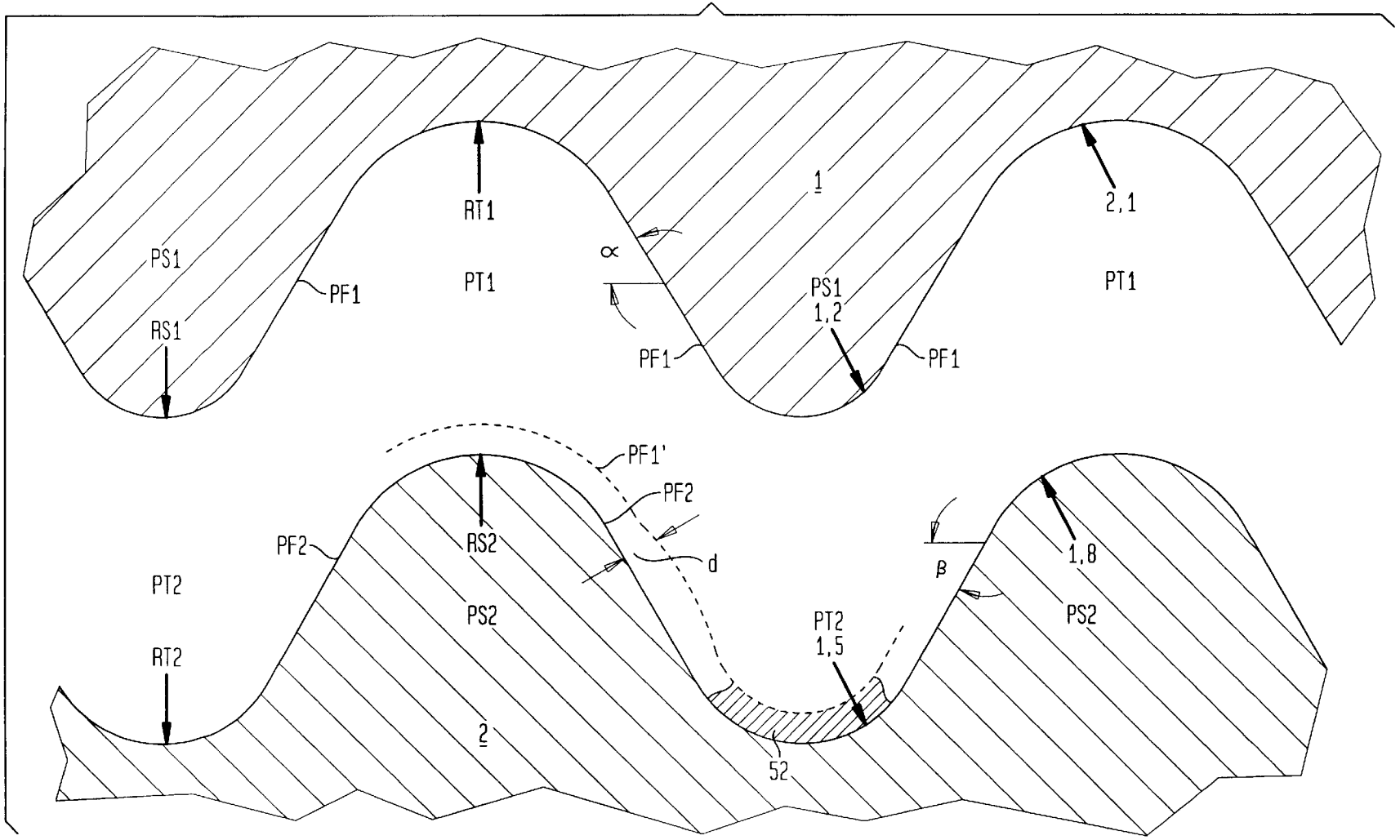
FIG. 2 shows the conditions of engagement between the two fluted rollers in a device according to the invention.

As illustrated in FIG. 2, the profile peaks PS1 and PS2 and the profile valleys PT1 and PT2, in the case of this example, run substantially parallel to the centerlines of the rollers, but may alternatively be inclined to them.

FIG. 2 shows the conditions of engagement between the first fluted roller 1 and the second fluted roller 2 in detail, in linearized or unwrapped form. The fluted roller 1 has profile peaks PS1 and profile valleys PT1 as well as flanks PF1 connecting them. The fluted roller 2 has profile peaks PS2 and profile valleys PT2 as well as profile flanks PF2 connecting them. In this exemplary case, the construction is such that the profile peaks PS1 have a curvature with a radium; of curvature RS1, the profile peaks PS2 have a circular cylindrical curvature with a radius of curvature RS2, the profile valleys PT1 have a circular cylindrical curvature with a radius of curvature RS2, the profile valleys PT1 have a circular cylindrical curvature with a radius of curvature RT1, the profile valleys PT2 have a circular cylindrical curvature with a radius of curvature RT, and that the profile flanks PS1 and PS2 are each formed by tangents to the adjoining circular cylindrical curvatures. The dotted line PF1' results from approach of the profile of the first fluted roller 1 to the profile of the second fluted roller 2. The distance between PF2 and PF1' corresponds approximately to the paper thickness of the corrugated strip 20, formed by compression of the corrugating strip 16 to make the corrugated strip 20 in the corrugating gap 3, as shown in FIG. 1.

It will readily be seen that the following inequalities are satisfied:

RS1<RT2;

RS2<RT1;

RS1<RS2; and

RT2<RT1, where the symbol "<" means "less than."

In this exemplary case the following values hold for the radii of curvature:

RS1=1.2 mm;

RT2=1.5 mm;

RS2=1.8 mm; and

RT1=2.1 mm.

Note the difference of the radii:

RT2 minus RS1=0.3 mm; and

RT1 minus RS2=0.3 mm.

Note further that the pitch of the profiles of fluted rollers 1 and 2 is the same. The diameters of the fluted rollers 1 and 2 may be equal or unequal.

Lastly, note also that the distance between the flanks PF2 and PF1', designated by d, has a maximum at mid-height of the flank, thus avoiding any pinch between the flanks during revolution of the fluted rollers 1, 2.

Figure 3:
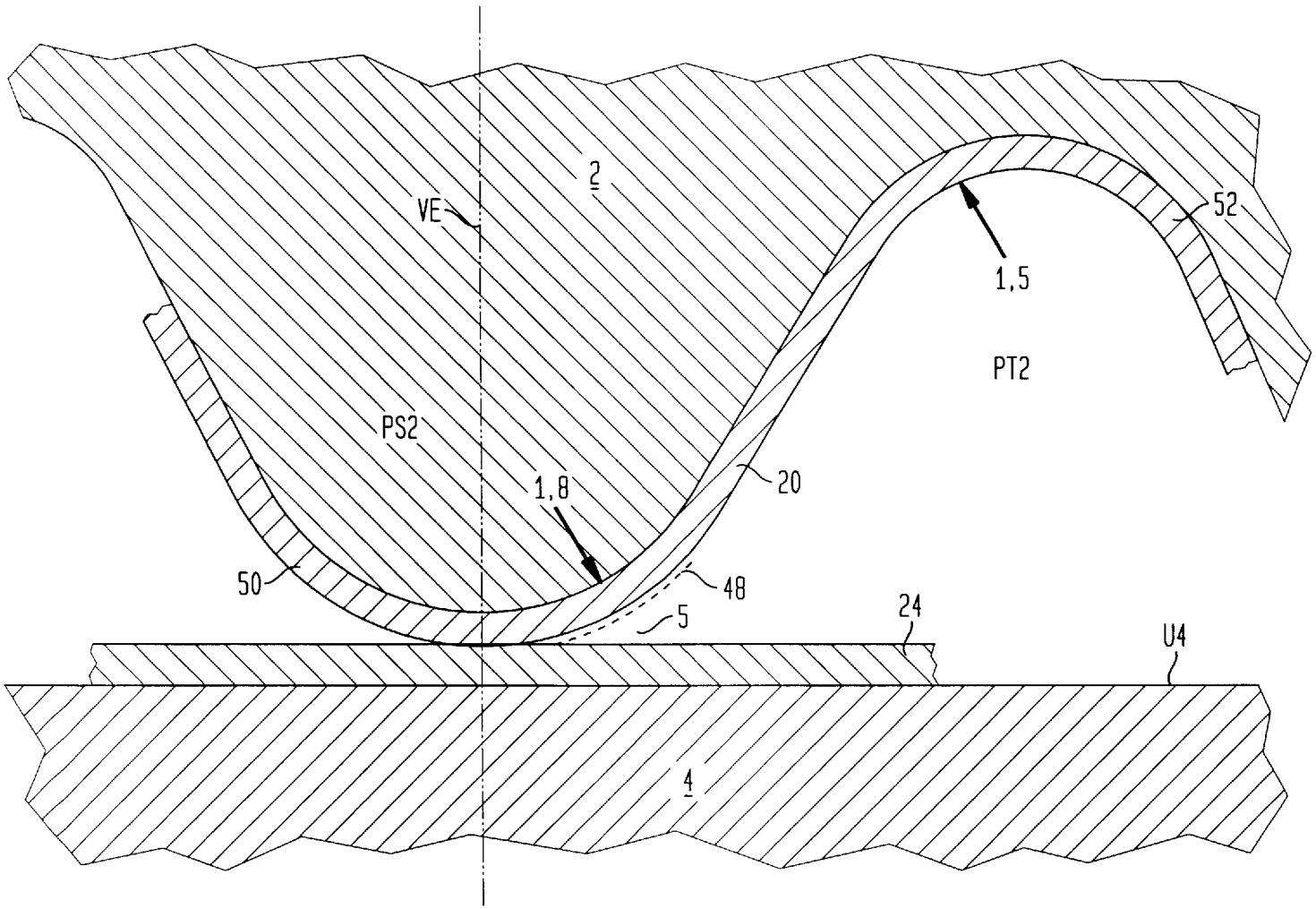
FIG. 3 shows the conditions of engagement in a device according to the invention between the second fluted roller and the pressure contact roller.

In FIG. 3, in linearized or unwrapped representation, a profile peak PS2 of fluted roller 2 is seen in engagement with a cylindrical periphery U4 of the pressure contact roller 4. Between the profile peak PS2 of the fluted roller 2 and the periphery of the pressure contact roller 4, the smooth strip 24 is pressed into contact with the corrugated strip 20, together with a glue layer 48 applied according to FIG. 1 by the gluing mechanism 32 to the crest 50 of the corrugated strip 20.

The relatively large radii of curvature RS2 of the profile peak PS2 and RT1 of the profile valley PT1 result in a relatively large radius of curvature (flatter curvature) of the crests 50 of the corrugations, where they are glued to the smooth strip 24 in the pressure contact gap 5, illustrated in FIG. 3. Here, therefore, a low vibrational pressure per unit area is produced.

The relatively sharply curved crests 52, when a "double face" corrugated cardboard is formed, come into contact with a plane surface of another plane strip, not shown here.

The machine runs more quietly because of the low pressure per unit area and the consequent weaker impacts between the rollers 2 and 4.

In the bonding of the crests 52 for the production of "double face" corrugated cardboard, there is less consumption of glue and "washboard effects" are avoided by the smaller glued area. The contraction factor remains practically the same as for a corresponding symmetrical profile (contraction factor being defined as the ratio of the length of the paper drawn in to be corrugated, to the length of the resulting corrugated cardboard). The flank angles $\alpha$ in FIG. 2 and $\beta$ in FIG. 2 may be kept approximately equal despite the large radii of curvature RT1 and RS2 compared to the conventional symmetric profiles.

I claim:

1. A device for producing corrugated cardboard, comprising:

a) a first fluted roller (1) and a second fluted roller (2), together forming a corrugating gap (3);

b) a pressure contact roller (4) forming a pressure contact gap (5) together with the second fluted roller (2);

c) feeding means (18) to feed a corrugating strip (16) to the corrugating gap (3), in which the corrugating strip (16) is formed into a corrugated strip (20);

d) feeding means (26, 28) to feed a smooth strip (24) to the pressure contact gap (5), in which the smooth strip (24) is pressed into contact with the corrugated strip (20) with intermediation of a glue layer to form a composite strip (34); and e) advancing means (36, 38, 40) to advance the composite strip (34) formed by combination of the corrugated strip (20) and the smooth strip (24); wherein each of the two fluted rollers (1, 2) is provided with a fluted profile on its periphery with profile peaks (PS1, PS2) and profile valleys (PT1, PT2), which cooperate to produce corrugation of the corrugating strip, while successive profile peaks (PS1, PS2) and profile valleys (PT1, PT2) of each fluted roller (1, 2) are joined to each other by profile flanks (PF1, PF2), and the profile peaks (PS1, PS2) of each fluted roller (1, 2) possess a sharper curvature than the profile valleys (PT2, PT1) of the respective meshing fluted roller, and wherein the profile peaks (PS1) of the first fluted roller (1) have a sharper curvature than the profile peaks (PS2) of the second fluted roller (2) and the profile valleys (PT1) of the first fluted roller (1) have a flatter curvature than the profile valleys (PT2) of the second fluted roller (2).

2. A device of claim 1 in which the profile peaks (PS1, PS2) of the two fluted rollers (1, 2) are curved in circular arcs and the profile peaks (PS1) of the first fluted roller (1) have a smaller radius of curvature (RS1) than the profile peaks (PS2) of the second fluted roller (2).

3. A device of claim 2 in which the profile valleys (PT1, PT2) of the two fluted rollers (1, 2) are curved in circular arcs and the profile valleys (PT1) of the first fluted roller (1) have a greater radius of curvature (RT1) than the profile valleys (PT2) of the second fluted roller (2).

4. A device of claim 1 in which the profile valleys (PT1, PT2) of the two fluted rollers (1, 2) are curved in circular arcs and the profile valleys (PT1) of the first fluted roller (1) have a greater radius of curvature (RT1) than the profile valleys (PT2) of the second fluted roller (2).

5. A device of claim 1 in which the two fluted rollers (1, 2) have the same pitch, with the same distance between successive profile peak vertices and successive profile valley vertices.

6. A device of claim 3 in which the difference in radius between the radius of curvature (RT2) of the profile valleys (PT2) of the second fluted roller (2) and the radius of curvature (RS1) of the profile peaks (PS1) of the first fluted roller (1) is approximately equal to the difference in radius between the radius of curvature (RT1) of the profile valleys (PT1) of the first fluted roller (1) and the radius of curvature (RS2) of the profile peaks (PS2) of the second fluted roller (2).

* * * * *